US008918042B2

(12) United States Patent
Imada et al.

(10) Patent No.: US 8,918,042 B2
(45) Date of Patent: Dec. 23, 2014

(54) FIXING DEVICE AND IMAGE FORMING APPARATUS INCLUDING THE FIXING DEVICE

(71) Applicants: Takahiro Imada, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Hiroshi Yoshinaga, Chiba (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(72) Inventors: Takahiro Imada, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Hiroshi Yoshinaga, Chiba (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 13/674,353

(22) Filed: Nov. 12, 2012

(65) Prior Publication Data

US 2013/0164056 A1 Jun. 27, 2013

(30) Foreign Application Priority Data

Dec. 26, 2011 (JP) ..... 2011-283383

(51) Int. Cl.
*G03G 15/20* (2006.01)

(52) U.S. Cl.
CPC ..... *G03G 15/2064* (2013.01)
USPC ..... 399/329; 399/320; 399/328

(58) Field of Classification Search
CPC ..... G03G 15/20; G03G 15/2064
USPC ..... 399/324, 328, 329
See application file for complete search history.

(56) References Cited

U.S. PATENT DOCUMENTS

| | | | | |
|---|---|---|---|---|
| 5,300,996 | A | 4/1994 | Yokoyama et al. | |
| 5,832,354 | A | 11/1998 | Kouno et al. | |
| RE36,124 | E | 3/1999 | Yokoyama et al. | |
| 5,915,147 | A | 6/1999 | Kouno et al. | |
| 6,671,488 | B2 * | 12/2003 | Izawa et al. | 399/329 |
| 7,203,453 | B2 * | 4/2007 | Naito et al. | 399/329 |
| 7,660,553 | B2 * | 2/2010 | Kikuchi | 399/329 |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0016963 | A1 | 1/2003 | Yoshinaga et al. | |
| 2003/0206758 | A1 | 11/2003 | Yasui et al. | |
| 2004/0013453 | A1 | 1/2004 | Shinshi et al. | |
| 2004/0247334 | A1 | 12/2004 | Kishi et al. | |
| 2004/0258426 | A1 | 12/2004 | Kishi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |

2005/0129432 A1 6/2005 Sato et al.
2005/0163543 A1 7/2005 Satoh et al.
2006/0051120 A1 3/2006 Kishi et al.
2006/0116230 A1 6/2006 Satoh et al.
2006/0165429 A1 7/2006 Satoh et al.
2006/0165448 A1 7/2006 Yoshinaga
2006/0177232 A1 8/2006 Ehara et al.
2006/0182460 A1 8/2006 Kishi et al.
2006/0285893 A1 12/2006 Ishii
2007/0014600 A1 1/2007 Ishii et al.
2007/0014603 A1 1/2007 Satoh et al.
2007/0059011 A1 3/2007 Seo et al.
2007/0059071 A1 3/2007 Shinshi et al.
2007/0110464 A1 5/2007 Nakayama et al.
2007/0212089 A1 9/2007 Seo et al.
2007/0280754 A1 12/2007 Ogawa et al.
2007/0292175 A1 12/2007 Shinshi
2008/0044196 A1 2/2008 Seo et al.
2008/0063443 A1 3/2008 Yoshinaga et al.
2008/0253789 A1 10/2008 Yoshinaga et al.
2008/0317532 A1 12/2008 Ehara et al.
2009/0041515 A1* 2/2009 Kim ..... 399/324
2009/0067902 A1 3/2009 Yoshinaga et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0245865 A1 10/2009 Shinshi et al.
2010/0074667 A1 3/2010 Ehara et al.
2010/0092220 A1 4/2010 Hasegawa et al.
2010/0092221 A1 4/2010 Shinshi et al.
2010/0158587 A1* 6/2010 Shin ..... 399/329
2010/0202809 A1 8/2010 Shinshi et al.
2010/0284713 A1* 11/2010 Li et al. ..... 399/328
2010/0290822 A1 11/2010 Hasegawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0076071 A1 3/2011 Yamaguchi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0170917 A1 7/2011 Yoshikawa et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229180 A1 9/2011 Saito
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0163884 A1* 6/2012 Kondo et al. ..... 399/329
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.
2013/0259544 A1* 10/2013 Ryu et al. ..... 399/328

FOREIGN PATENT DOCUMENTS

JP 4-044083 2/1992
JP 2004-286922 10/2004
JP 2006-313256 11/2006
JP 2007-108212 4/2007
JP 2007-233011 9/2007
JP 2007-334205 12/2007
JP 2009-288284 12/2009

* cited by examiner

*Primary Examiner* — Clayton E LaBalle
*Assistant Examiner* — Ruifeng Pu
(74) *Attorney, Agent, or Firm* — Harness, Dickey & Pierce P.L.C.

(57) ABSTRACT

A fixing device for fixing an image on a recording medium includes a rotatable endless fixing rotary member, a heating source which heats the fixing rotary member, an opposite rotary member in contact with the fixing rotary member, a nip forming member provided inside the fixing rotary member and in contact with the opposite rotary member via the fixing rotary member to form a nip portion to which the recording medium is fed, holding members rotatably holding end portions of the fixing rotary member, and protecting members provided between the holding members and end surfaces of the fixing rotary member to protect the end portions. Each of the protecting members has an opposite surface facing the corresponding end surface of the fixing rotary member, and including an inner diameter-side end edge having an inclined surface inclined in an inner diameter direction and away from the fixing rotary member.

15 Claims, 9 Drawing Sheets

FIXING DEVICE AND IMAGE FORMING APPARATUS INCLUDING THE FIXING DEVICE

CROSS-REFERENCE TO RELATED APPLICATION

This patent application is based on and claims priority pursuant to 35 U.S.C. §119 to Japanese Patent Application No. 2011-283383, filed on Dec. 26, 2011, in the Japanese Patent Office, the entire disclosure of which is hereby incorporated by reference herein.

BACKGROUND OF THE INVENTION

1. Field of the Invention

The present invention relates to a fixing device which fixes an image on a recording medium, and an image forming apparatus including the fixing device.

2. Description of the Related Art

In recent years, demand for energy conservation and increase in processing speed has been increasing in the market for image forming apparatuses, such as printers, copiers, and facsimile machines.

In such an image forming apparatus, an unfixed toner image is formed on a recording medium, such as a recording medium sheet, a print sheet, a photosensitive sheet, or an electrostatic recording sheet, through an image forming process based on, for example, electrophotographic, electrostatic, or magnetic recording in accordance with an image transfer method or a direct image formation method. As a fixing device for fixing the unfixed toner image on the recording medium, a fixing device employing a contact heating method, such as a heat roller method, a film heating method, or an electromagnetic induction heating method is widely employed.

Such a fixing device includes, for example, a fixing device employing a belt fixing method and a fixing device employing a surface rapid fixing (SURF) method using a ceramic heater, i.e., a film fixing method.

In recent years, a reduction in warm-up time and first-print time has been demanded of the fixing device employing the belt fixing method (hereinafter referred to as the first issue). The warm-up time refers to the time taken to raise the temperature from a normal temperature to a predetermined reload temperature allowing printing when, for example, power is turned on. The first-print time refers to the time from the reception of a print request to the completion of a sheet discharging operation followed by a print preparatory operation and a printing operation.

Further, along with the increase in processing speed of the image forming apparatus, the number of sheets fed per unit time is increased, and the necessary heat amount is increased. As a result, a so-called temperature drop, i.e., a shortage of heat occurs at the beginning of continuous printing (hereinafter referred to as the second issue).

Meanwhile, in the fixing device employing the SURF method using a ceramic heater, a reduction in heat capacity and device size is achievable, as compared with the fixing device employing the belt fixing method. Accordingly, the above-described first issue is well addressed by the SURF method. The SURF method, however, locally heats a nip portion of a belt, and does not heat the remaining portion of the belt. At a location such as the entrance of the nip portion for receiving the recording medium, therefore, the belt temperature is substantially low, and a fixing failure tends to occur. The fixing failure tends to occur particularly in high-speed image forming apparatuses, in which the belt rotation speed is relatively high and the amount of heat discharged from the belt is increased in the remaining portion other than the nip portion (hereinafter referred to as the third issue).

To address the above-described first to third issues, background fixing devices using an endless belt are configured to obtain favorable fixing performance even when installed in a high-speed image forming apparatus.

As illustrated in FIG. 1, the background fixing device includes an endless belt 100, a metal heat conductor 200, a heat source 300, and a pressure roller 400. The metal heat conductor 200 is formed into a pipe shape, and is disposed inside the endless belt 100. The heat source 300 is disposed inside the metal heat conductor 200. The pressure roller 400 is in contact with the metal heat conductor 200 via the endless belt 100 to form a nip portion N. The endless belt 100 is rotated by the rotation of the pressure roller 400. In this process, the metal heat conductor 200 guides the movement of the endless belt 100. Further, the endless belt 100 is heated, via the metal heat conductor 200, by the heat source 300 inside the metal heat conductor 200. Thereby, the entire endless belt 100 is heated. Accordingly, the first-print time following a heating standby time is reduced, and the shortage of heat in high-speed belt rotation is minimized.

To achieve further energy conservation and reduction in first-print time, it is desired to improve the thermal efficiency of the heating unit. In view of this, the fixing device may also be configured not to indirectly heat the endless belt 100 via the metal heat conductor 200, but to directly heat the endless belt 100 without using the metal heat conductor 200.

As illustrated in FIG. 2, in this configuration, the pipe-shaped metal heat conductor 200 is removed from the inside of the endless belt 100, and is replaced by a plate-shaped nip forming member 500 provided at a position facing the pressure roller 400. In this configuration, a portion of the endless belt 100 other than a portion of the endless belt 100 contacting the nip forming member 500 is directly heated by the heat source 300, thereby substantially improving heat transfer efficiency and reducing power consumption. Accordingly, the first-print time following the heating standby time is further reduced, and moreover a reduction in cost due to the absence of the metal heat conductor 200 can be expected.

A fixing device using an endless belt, such as the above-described fixing device, normally includes restricting members which restrict belt walk in the axial direction thereof. For example, as illustrated in FIG. 3, the background fixing device may include fixing flanges 600 which rotatably hold opposite end portions of the endless belt 100 and restrict belt walk in the axial direction thereof. The background fixing device further includes, between the fixing flanges 600 and the end portions of the endless belt 100, driven rings 700 serving as protecting members for protecting the end portions of the endless belt 100. If the endless belt 100 is subjected to a force exerted in the axial direction thereof and walks toward one side, an end portion of the endless belt 100 hits against the corresponding one of the driven rings 700, and the driven ring 700 rotates together with the endless belt 100. Thereby, friction between the end portion of the endless belt 100 and the flange 600 is prevented.

FIG. 4 is a cross-sectional side view of the background fixing device illustrated in FIG. 3. As illustrated in FIG. 4, in the nip portion N, the endless belt 100 is pressed toward the inner diameter thereof by the pressure roller 400, and is recessed inward from an inner circumferential surface 700*a* of the driven ring 700. If the endless belt 100 walks, therefore, an end portion of the endless belt 100 comes into sliding contact with an edge E of the inner circumferential surface 700*a* of the driven ring 700 in the area in which the endless belt 100 is recessed inward from the inner circumferential surface 700*a* of the driven ring 700, as illustrated in FIG. 5. As a result, the end portion of the endless belt 100 is damaged by stress concentrated thereon owing to the sliding contact.

Further, the endless belt tends to be formed with a reduced thickness to meet the demand in recent years for energy conservation and reduction in first-print time. As a result, the above-described damage of the endless belt is more likely to occur particularly in a fixing device using such a relatively thin endless belt owing to the reduction in strength of the endless belt.

SUMMARY OF THE INVENTION

The present invention describes a novel fixing device. In one example, a novel fixing device fixes an unfixed image on a recording medium, and includes a rotatable endless fixing rotary member, a heating source, an opposite rotary member, a nip forming member, holding members, and protecting members. The fixing rotary member is configured to come into contact with the unfixed image carried on the recording medium. The heating source is configured to heat the fixing rotary member. The opposite rotary member is configured to be in contact with an outer circumferential surface of the fixing rotary member. The nip forming member is provided inside the fixing rotary member, and is configured to be in contact with the opposite rotary member via the fixing rotary member to form, between the fixing rotary member and the opposite rotary member, a nip portion to which the recording medium carrying the unfixed image is fed. The holding members are configured to rotatably hold end portions of the fixing rotary member. The protecting members are provided between the holding members and end surfaces of the fixing rotary member, and are configured to protect the end portions of the fixing rotary member. Each of the protecting members has an opposite surface which faces the corresponding one of the end surfaces of the fixing rotary member, and which includes an inner diameter-side end edge provided with an inclined surface inclined in an inner diameter direction and away from the fixing rotary member.

The inclined surface may include a substantially flat surface.

The inclined surface may include a curved surface.

In the nip portion, the fixing rotary member may be pressed toward the inner diameter thereof by the opposite rotary member and recessed inward from the inner diameter-side end edge of each of the protecting members.

Each of the holding members may include an insertion portion inserted in the corresponding one of the end portions of the fixing rotary member and larger in outer diameter than the inclined surface.

The inclined surface of each of the protecting members may have a lower coefficient of friction than the remaining portion of the protecting member.

The inclined surface may be coated with a material having a coefficient of friction lower than that of the inclined surface.

The fixing device may further include a lubricant applied to the inclined surface.

The present invention further describes a novel image forming apparatus. In one example, a novel image forming apparatus includes an image forming unit configured to form an unfixed image on a recording medium and the above-described fixing device configured to fix the unfixed image on the recording medium.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
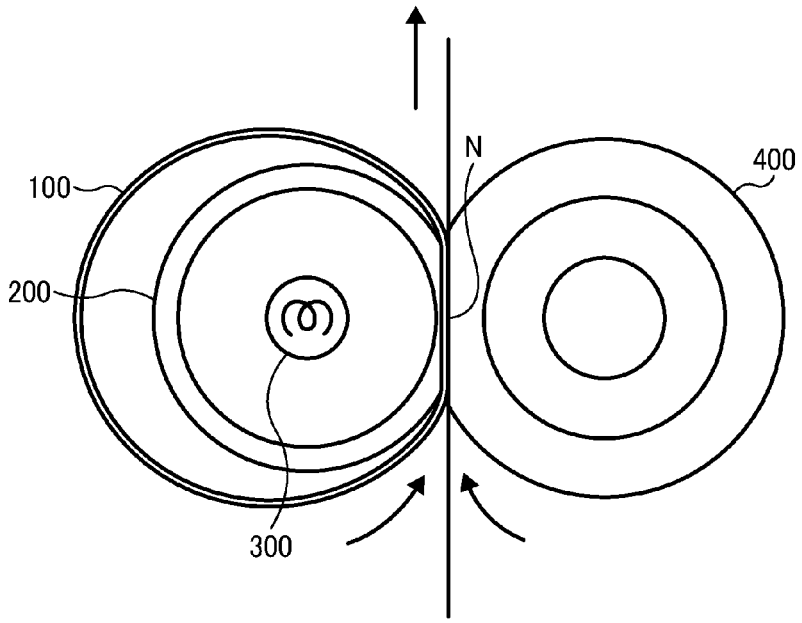
FIG. 1 RELATED ART
FIG. 1 is a schematic configuration diagram of a related-art fixing device.
Figure 2:
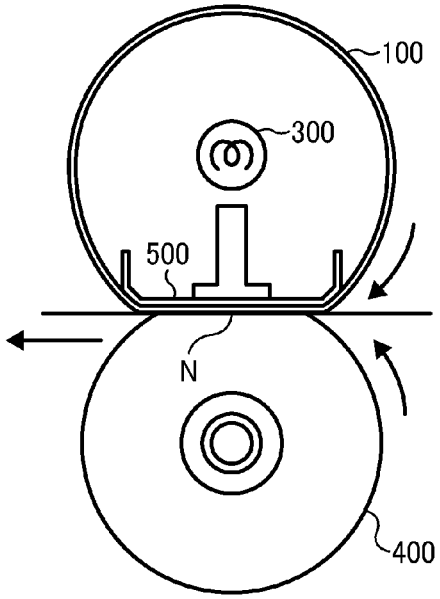
FIG. 2 RELATED ART
FIG. 2 is a schematic configuration diagram of another related-art fixing device.
Figure 3:
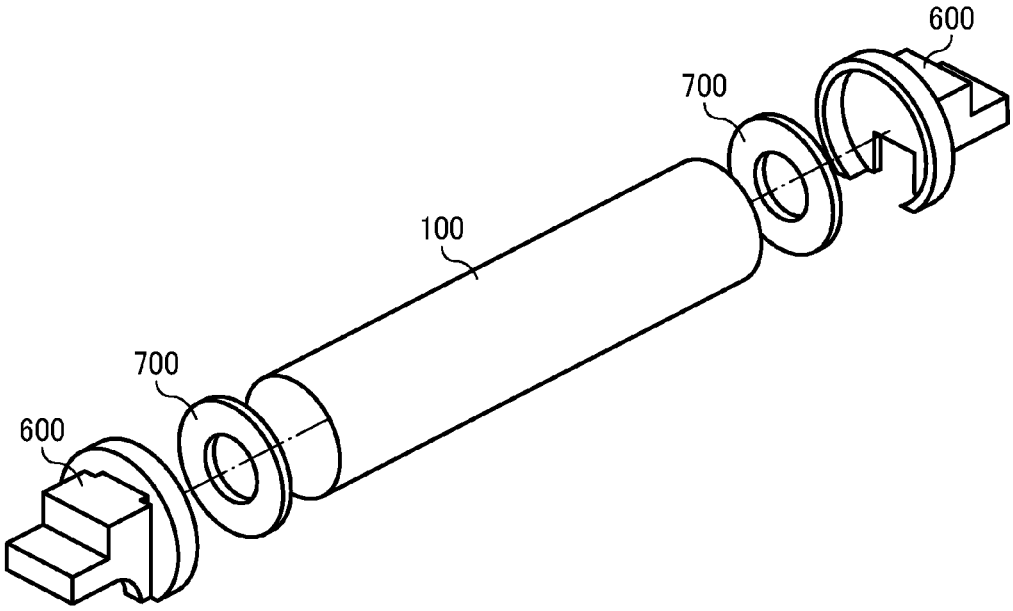
FIG. 3 RELATED ART
FIG. 3 is a perspective view of another related-art fixing device, illustrating the configuration of belt holding members and driven rings provided to end portions of an endless belt.
Figure 4:
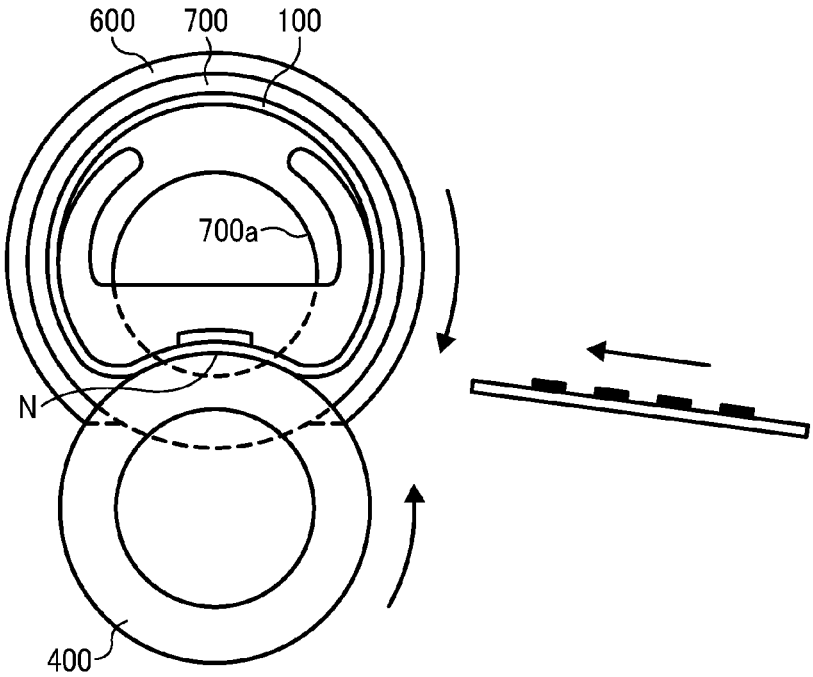
FIG. 4 RELATED ART
FIG. 4 is a cross-sectional side view of the related-art fixing device in FIG. 3, illustrating a state in which the endless belt is pressed and recessed inward from an inner circumferential surface of a driven ring in a nip portion.
Figure 5:
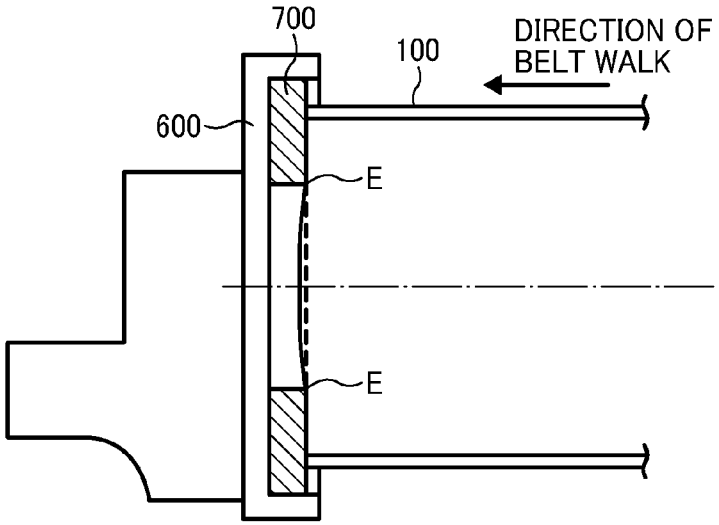
FIG. 5 RELATED ART
FIG. 5 is a diagram illustrating a state in which an end portion of the endless belt in FIG. 4 is in contact with an inner diameter-side end edge of the driven ring.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieve a similar result.

Referring now to the drawings, wherein like reference numerals designate members or components having the same function or shape throughout the several views, embodiments of the present invention will be described. In the following, redundant description of members or components once described will be omitted.

Figure 6:
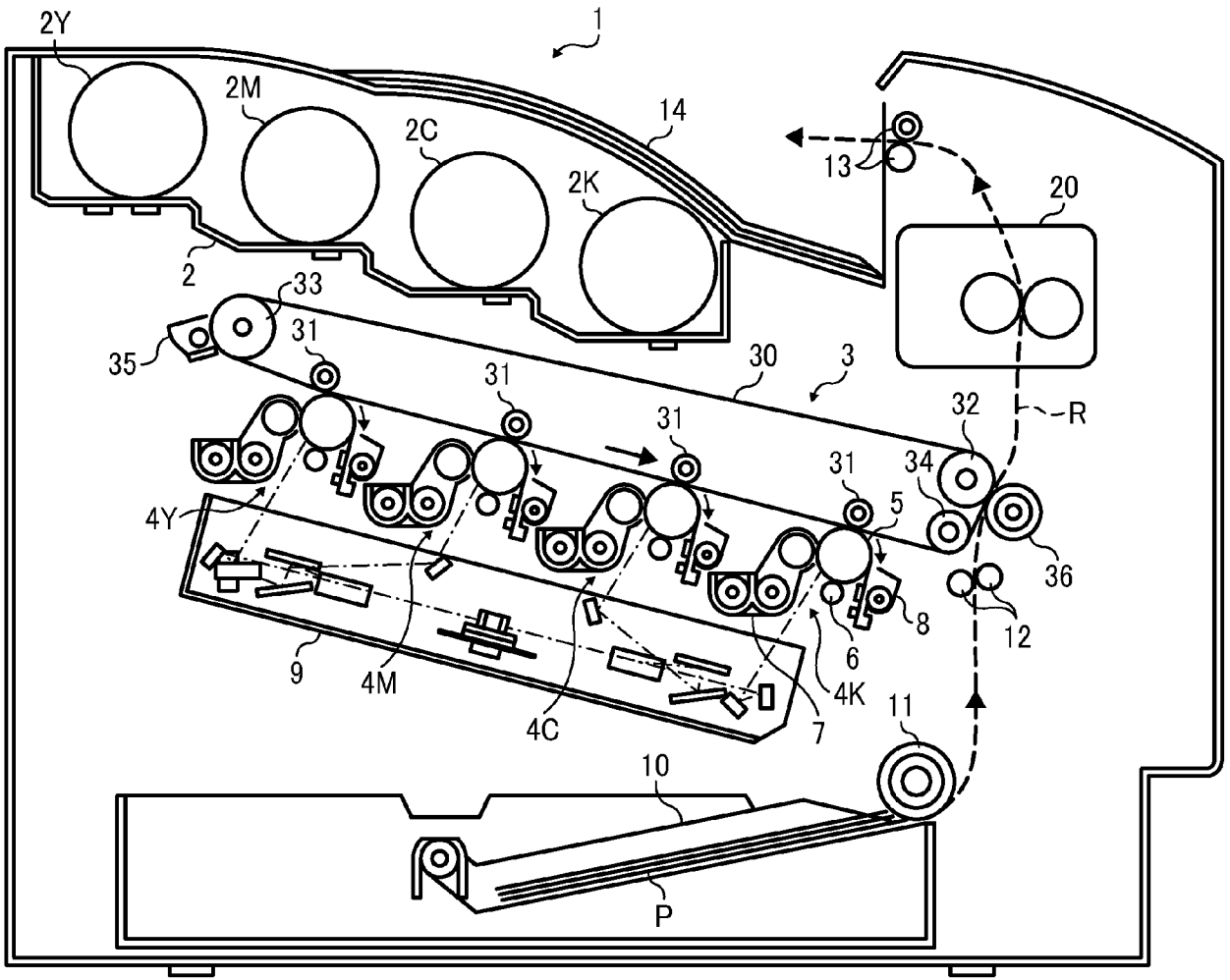
FIG. 6 is a schematic configuration diagram illustrating an image forming apparatus according to an embodiment of the present invention.

With reference to FIG. 6, a description will first be given of the overall configuration and operation of an image forming apparatus according to an embodiment of the present invention. An image forming apparatus 1 illustrated in FIG. 6 is a color laser printer including four image forming units 4Y, 4M, 4C, and 4K disposed at substantially the center of the body thereof. The image forming units 4Y, 4M, 4C, and 4K are similar in configuration except for the difference in color of developers contained therein. That is, the image forming units 4Y, 4M, 4C, and 4K contain developers of yellow (Y), magenta (M), cyan (C), and black (K) colors, respectively, which correspond to color separation components of a color image.

Specifically, each of the image forming units 4Y, 4M, 4C, and 4K includes a drum-shaped photoconductor 5 serving as a latent image carrier, a charging device 6 which charges the outer circumferential surface of the photoconductor 5, a development device 7 which supplies toner to the outer circumferential surface of the photoconductor 5, and a cleaning device 8 which cleans the outer circumferential surface of the photoconductor 5. In FIG. 6, reference numerals are assigned to the photoconductor 5, the charging device 6, the development device 7, and the cleaning device 8 included in the image forming unit 4K for the black color, and are omitted in the other image forming units 4Y, 4M, and 4C.

Below the image forming units 4Y, 4M, 4C, and 4K, an exposure device 9 is provided which performs an exposure process on the respective outer circumferential surfaces of the photoconductors 5. The exposure device 9, which includes light sources, a polygon minor, f-θ lenses, and reflecting mirrors, applies laser lights to the outer circumferential surfaces of the photoconductors 5 on the basis of image data.

Above the image forming units 4Y, 4M, 4C, and 4K, a transfer device 3 is provided which includes an intermediate transfer belt 30 serving as a transfer member, four primary transfer rollers 31 serving as primary transfer devices, a secondary transfer roller 36 serving as a secondary transfer device, a secondary transfer backup roller 32, a cleaning backup roller 33, a tension roller 34, and a belt cleaning device 35.

The intermediate transfer belt 30 is an endless belt stretched by the secondary transfer backup roller 32, the cleaning backup roller 33, and the tension roller 34. In the present embodiment, the secondary transfer backup roller 32 is driven to rotate, and causes the intermediate transfer belt 30 to circularly move (i.e., rotate) in the direction indicated by the corresponding arrow in FIG. 6.

The four primary transfer rollers 31 and the photoconductors 5 hold the intermediate transfer belt 30 therebetween to form primary transfer nips. Each of the primary transfer rollers 31 is connected to a not-illustrated power supply, and is applied with a predetermined direct-current (DC) voltage and/or a predetermined alternating-current (AC) voltage.

The secondary transfer roller 36 and the secondary transfer backup roller 32 hold the intermediate transfer belt 30 therebetween to form a secondary transfer nip. Similarly to the primary transfer rollers 31, the secondary transfer roller 36 is connected to a not-illustrated power supply, and is applied with a predetermined DC voltage and/or a predetermined AC voltage.

The belt cleaning device 35 includes a cleaning brush and a cleaning blade, which are disposed to be in contact with the intermediate transfer belt 30. A not-illustrated waste toner transport tube extending from the belt cleaning device 35 is connected to an inlet of a not-illustrated waste toner container.

In an upper portion of the body of the image forming apparatus 1, a bottle housing unit 2 is provided. Four toner bottles 2Y, 2M, 2C, and 2K each containing a refill toner are installed in the bottle housing unit 2 to be attachable thereto and detachable therefrom. Not-illustrated refill paths are provided between the toner bottles 2Y, 2M, 2C, and 2K and the development devices 7 to allow the development devices 7 to be refilled with the toners from the toner bottles 2Y, 2M, 2C, and 2K via the refill paths.

Meanwhile, in a lower portion of the body of the image forming apparatus 1, a sheet feeding tray 10 and a sheet feed roller 11 are provided. The sheet feeding tray 10 stores a sheet P serving as a recording medium, and the sheet feed roller 11 feeds the sheet P from the sheet feeding tray 10. Herein, the recording medium includes, as well as a plain paper sheet, a cardboard sheet, a postcard, an envelop, a thin paper sheet, a coated paper sheet, an art paper sheet, a tracing paper sheet, and an overhead projector (OHP) sheet, for example. The image forming apparatus 1 may also include a manual sheet feeding mechanism, which is not illustrated herein.

In the body of the image forming apparatus 1, a feed path R is provided to allow the sheet P fed from the sheet feeding tray 10 to pass through the secondary transfer nip and be discharged outside the image forming apparatus 1. On the upstream side of the secondary transfer roller 36 in the sheet feeding direction, the feed path R is provided with a registration roller pair 12 serving as a feeding device which feeds the sheet P to the secondary transfer nip.

On the downstream side of the secondary transfer roller 36 in the sheet feeding direction, the feed path R is provided with a fixing device 20 that fixes an unfixed image transferred to the sheet P. On the downstream side of the fixing device 20 in the sheet feeding direction, the feed path R is provided with a sheet discharge roller pair 13 which discharges the sheet P outside the image forming apparatus 1. Further, an upper surface portion of the body of the image forming apparatus 1 forms a sheet discharge tray 14 onto which the sheet P is discharged outside the image forming apparatus 1.

With reference to FIG. 6, basic operation of the image forming apparatus 1 according to the present embodiment will now be described. When an image forming operation starts, the photoconductors 5 of the image forming units 4Y, 4M, 4C, and 4K are driven to rotate in the clockwise direction in FIG. 6 by not-illustrated driving devices. Then, the outer circumferential surfaces of the photoconductors 5 are uniformly charged to a predetermined polarity by the charging devices 6. The charged outer circumferential surfaces of the photoconductors 5 are irradiated with laser lights by the exposure device 9. Thereby, electrostatic latent images are formed on the outer circumferential surfaces of the photoconductors 5. The exposure process is performed on each of the photoconductors 5 with image information of a single color separated from a desired full-color image, i.e., color information of the corresponding one of the yellow, magenta, cyan, and black colors. The electrostatic latent images thus formed on the photoconductors 5 are then supplied with the toners by the development devices 7. Thereby, the electrostatic latent images are visualized into toner images.

Further, when the image forming operation starts, the secondary transfer backup roller 32 is driven to rotate in the counterclockwise direction in FIG. 6, and causes the intermediate transfer belt 30 to circularly move in the direction indicated by the corresponding arrow in FIG. 6. Then, each of the primary transfer rollers 31 is applied with a constant voltage or a constant current-controlled voltage having a polarity opposite to a toner charge polarity. Thereby, transfer electric fields are generated in the primary transfer nips between the primary transfer rollers 31 and the photoconductors 5.

Thereafter, in accordance with the rotation of the photoconductors 5, the toner images of the respective colors on the photoconductors 5 reach the respective primary transfer nips, and are sequentially superimposed and transferred onto the intermediate transfer belt 30 by the transfer electric fields generated in the primary transfer nips. Thereby, a full-color toner image is carried by the outer circumferential surface of the intermediate transfer belt 30. Residual toners having failed to be transferred to the intermediate transfer belt 30 and remaining on the photoconductors 5 are removed by the cleaning devices 8. Thereafter, the outer circumferential surfaces of the photoconductors 5 are discharged by not-illustrated discharging devices, and respective surface potentials of the photoconductors 5 are initialized.

In a lower portion of the image forming apparatus 1, the sheet feed roller 11 starts to be driven to rotate, and feeds the sheet P to the feed path R from the sheet feeding tray 10. The sheet P fed to the feed path R is fed into the secondary transfer nip between the secondary transfer roller 36 and the secondary transfer backup roller 32 with appropriate timing by the registration roller pair 12. In this process, the secondary transfer roller 36 is applied with a transfer voltage having a polarity opposite to the toner charge polarity of the toner images on the intermediate transfer belt 30 to generate a transfer electric field in the secondary transfer nip.

Thereafter, in accordance with the circular movement of the intermediate transfer belt 30, the toner images on the intermediate transfer belt 30 reach the secondary transfer nip, and are transferred at the same time onto the sheet P by the transfer electric field generated in the secondary transfer nip. Residual toners having failed to be transferred to the sheet P and remaining on the intermediate transfer belt 30 are removed by the belt cleaning device 35 and transported to the not-illustrated waste toner container.

Thereafter, the sheet P is fed to the fixing device 20, and the toner images on the sheet P are fixed on the sheet P by the fixing device 20. Then, the sheet P is discharged outside the image forming apparatus 1 by the sheet discharge roller pair 13, and is placed onto the sheet discharge tray 14.

Although the above description has been made of the image forming operation of forming a full-color image on the sheet P, the image forming apparatus 1 is also capable of forming a monochromatic image by using one of the four image forming units 4Y, 4M, 4C, and 4K, and forming an image of two or three colors by using two or three of the image forming units 4Y, 4M, 4C, and 4K.

Figure 7:
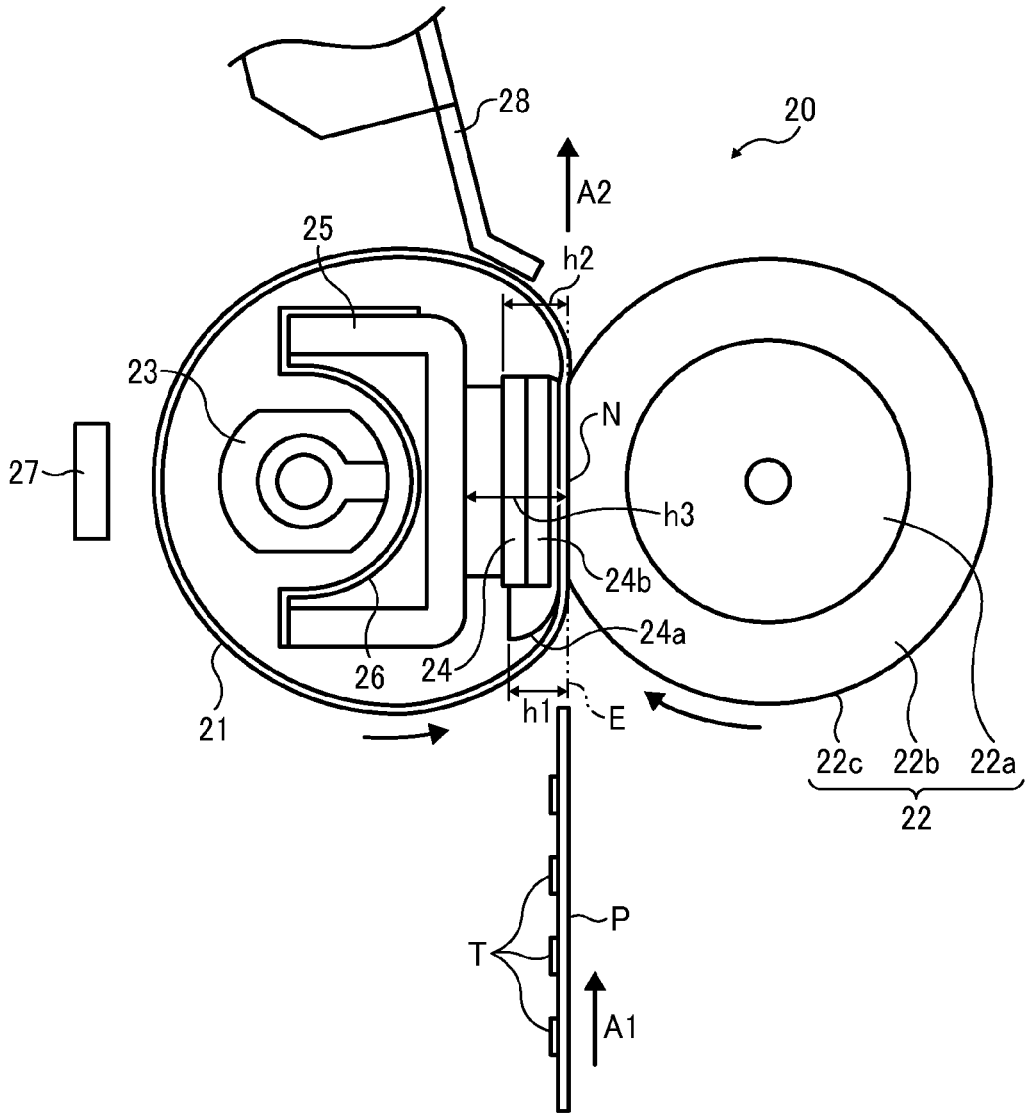
FIG. 7 is a schematic configuration diagram of a fixing device according to a first embodiment of the present invention.

The configuration of the fixing device 20 will now be described with reference to FIG. 7. As illustrated in FIG. 7, the fixing device 20 includes a fixing belt 21, a pressure roller 22, a halogen heater 23, a nip forming member 24, a stay 25, a reflector 26, a temperature sensor 27, a separator 28, and a not-illustrated biasing member. The fixing belt 21 serves as a rotatable fixing rotary member. The pressure roller 22 serves as an opposite rotary member rotatably provided to face the fixing belt 21. The halogen heater 23 serves as a heating source which heats the fixing belt 21. The nip forming member 24 is provided inside the fixing belt 21. The stay 25 serves as a support member which supports the nip forming member 24. The reflector 26 reflects light radiated from the halogen heater 23 to the fixing belt 21. The temperature sensor 27 serves as a temperature detector which detects the temperature of the fixing belt 21. The separator 28 separates the sheet P from the fixing belt 21. The biasing member biases the pressure roller 22 against the fixing belt 21.

The fixing belt 21 is a relatively thin, flexible endless belt member or film. Specifically, the fixing belt 21 includes a substrate on the inner circumferential side and a release layer on the outer circumferential side. The substrate is made of a metal material, such as nickel and stainless steel (SUS), or a resin material, such as polyimide (PI). The release layer is made of, for example, tetrafluoroethylene-perfluoroalkyl vinyl ether copolymer (PFA) or polytetrafluoroethylene (PTFE). An elastic layer made of a rubber material, such as a silicone rubber, a foamed silicone rubber, and a fluororubber, may be provided between the substrate and the release layer.

The pressure roller 22 includes a core bar 22*a*, an elastic layer 22*b*, and a release layer 22*c*. The elastic layer 22*b* is made of a foamed silicone rubber, a silicone rubber, or a fluororubber, for example, and provided on the outer circumferential surface of the core bar 22*a*. The release layer 22*c* is made of PFA or PTFE, for example, and provided on the outer circumferential surface of the elastic layer 22*b*. The pressure roller 22 is biased toward the fixing belt 21 by the not-illustrated biasing member to be in contact with the nip forming member 24 via the fixing belt 21. In the area of pressure contact between the pressure roller 22 and the fixing belt 21, the elastic layer 22*b* of the pressure roller 22 deforms to form a nip portion N having a predetermined width. Further, the pressure roller 22 is configured to be driven to rotate by a not-illustrated drive source, such as a motor, provided to the body of the image forming apparatus 1. When the pressure roller 22 is driven to rotate, drive force of the pressure roller 22 is transmitted to the fixing belt 21 in the nip portion N, and thereby the fixing belt 21 is driven to rotate.

Although the pressure roller 22 of the present embodiment is a solid roller, alternatively the pressure roller 22 may be a hollow roller. In that case, a heating source, such as a halogen heater, may be provided inside the pressure roller 22. Further, if the elastic layer 22*b* is absent, the heat capacity is reduced, and the fixing performance is improved. In the process of pressing and fixing the unfixed toner on the sheet P, however, minute irregularities of the outer circumferential surface of the fixing belt 21 may be transferred to the image and cause unevenness of gloss in a solid portion of the image. To prevent such a phenomenon, it is desired to provide an elastic layer having a thickness of approximately 100 μm or more. If an elastic layer having a thickness of approximately 100 μm or more is provided, the above-described minute irregularities are absorbed by the elastically deformed elastic layer, and thus the unevenness of gloss is prevented. The elastic layer 22*b* may be made of solid rubber. If there is no heating source inside the pressure roller 22, the elastic layer 22*b* may be made of sponge rubber. It is more desirable to use the sponge rubber to form the elastic layer 22*b* in that the sponge rubber improves heat insulation and suppresses heat loss of the fixing belt 21, as compared with the solid rubber. Further, the configuration of the fixing belt 21 serving as the fixing rotary member and the pressure roller 22 serving as the opposite rotary member is not limited to the configuration in which the fixing belt 21 and the pressure roller 22 press against each other. For example, the fixing belt 21 and the pressure roller 22 may be configured to simply be in contact with each other, with no pressure applied thereto.

The halogen heater 23 has opposite end portions fixed to not-illustrated side plates of the fixing device 20. The halogen heater 23 is configured to generate heat under output control by a not-illustrated power supply unit provided to the body of the image forming apparatus 1. The output control is performed on the basis of the result of detection of the surface temperature of the fixing belt 21 by the temperature sensor 27. With this output control of the halogen heater 23, the temperature of the fixing belt 21, i.e., the fixing temperature is adjustable to a desired temperature. Further, the heating source for heating the fixing belt 21 is not limited to a halogen heater, and alternatively may be an induction heater (IH), a resistance heater, or a carbon heater, for example.

The nip forming member 24 is provided to extend in the axial direction of the fixing belt 21, i.e., the axial direction of the pressure roller 22, and is fixedly supported by the stay 25. This configuration prevents the nip forming member 24 from being bent by the pressure applied by the pressure roller 22, and maintains a uniform nip width in the axial direction of the pressure roller 22. To obtain a satisfactory function of preventing the bending of the nip forming member 24, it is desired to use a metal material having relatively high mechanical strength, such as stainless steel and iron, to form the stay 25. Further, the stay 25 is formed to have an elongated cross section extending in the pressurizing direction of the pressure roller 22. Thereby, the section modulus is increased, and the mechanical strength of the stay 25 is increased.

The nip forming member 24 is a heat resistant member having a heat resistant temperature of approximately 200 degrees Celsius or higher. Accordingly, deformation of the nip forming member 24 due to heat is prevented in a toner fixing temperature range, and a stable state of the nip portion N is secured to provide consistently good quality of the output image. The nip forming member 24 may be made of a commonly used heat resistant resin, such as polyether sulfone (PES), polyphenylene sulfide (PPS), liquid crystal polymer (LCP), polyether nitrile (PEN), polyamide-imide (PAI), and polyether ether ketone (PEEK). The nip forming member 24 of the present embodiment is made of TI-8000, which is an LCP produced by Toray Industries, Inc.

Further, the nip forming member 24 includes a not-illustrated low-friction sheet provided on a surface thereof. When rotated, the fixing belt 21 slides over the low-friction sheet. Thereby, drive torque generated in the fixing belt 21 is reduced, and a load on the fixing belt 21 due to frictional force is reduced. Toyoflon (registered trademark) produced by Toray Industries, Inc., for example, is preferable as the material forming the low-friction sheet.

The reflector 26 is provided between the stay 25 and the halogen heater 23. In the present embodiment, the reflector 26 is fixed to the stay 25. With the thus-provided reflector 26, the light radiated from the halogen heater 23 toward the stay 25 is reflected to the fixing belt 21. Thereby, the amount of light applied to the fixing belt 21 is increased, and the fixing belt 21 is efficiently heated. Further, the transfer of radiant heat from the halogen heater 23 to components such as the stay 25 is minimized. Accordingly, energy conservation is achieved.

The fixing device 20 according to the present embodiment has various features for achieving further energy conservation and reduction in first-print time. Specifically, a portion of the fixing belt 21 other than a portion of the fixing belt 21 corresponding to the nip portion N is directly heated by the halogen heater 23, i.e., heated by a direct heating method. In the present embodiment, the space between the halogen heater 23 and a left portion of the fixing belt 21 in FIG. 7 is not provided with any component, such that the radiant heat from the halogen heater 23 is directly applied to the fixing belt 21 in the space.

Further, to reduce the heat capacity of the fixing belt 21, the fixing belt 21 is reduced in thickness and diameter. Specifically, the respective thicknesses of the substrate, the elastic layer, and the release layer forming the fixing belt 21 are set to a range from approximately 20 μm to approximately 50 μm, a range from approximately 100 μm to approximately 300 μm, and a range from approximately 10 μm to approximately 50 μm, respectively, and the overall thickness of the fixing belt 21 is set to approximately 1 mm or less. Further, the diameter of the fixing belt 21 in its deployed looped configuration is set to a range from approximately 20 mm to approximately 40 mm. To achieve a further reduction in heat capacity, it is desired to set the overall thickness of the fixing belt 21 to approximately 0.2 mm or less, more preferably approximately 0.16 mm or less, and to set the diameter of the fixing belt 21 in its deployed looped configuration to approximately 30 mm or less.

In the present embodiment, the diameter of the pressure roller 22 in its deployed looped configuration is set to a range from approximately 20 mm to approximately 40 mm, i.e., the fixing belt 21 and the pressure roller 22 are configured to have a substantially equal diameter. The configuration of the fixing belt 21 and the pressure roller 22, however, is not limited to the above. For example, the fixing belt 21 and the pressure roller 22 may be configured such that the fixing belt 21 is smaller in diameter in its deployed looped configuration than the pressure roller 22. In that case, the curvature of the fixing belt 21 is less than the curvature of the pressure roller 22 in the nip portion N, and thus the sheet P fed out of the nip portion N is more easily separated from the fixing belt 21.

The above-described reduction in diameter of the fixing belt 21 results in a reduction of the space inside the fixing belt 21. However, the stay 25 is bent at opposite ends thereof to be formed into a recessed shape, and the halogen heater 23 is housed inside the recessed stay 25. Accordingly, the reduced space is still capable of housing the stay 25 and the halogen heater 23.

Further, to increase the size of the stay 25 as much as possible in the reduced space, the size of the nip forming member 24 is conversely reduced. Specifically, the width of the nip forming member 24 in the sheet feeding direction is set to be less than the width of the stay 25 in the sheet feeding direction. Further, in FIG. 7, the nip forming member 24 includes an upstream end portion 24*a* and a downstream end portion 24*b* in the sheet feeding direction, and the stay 25 includes an upstream bent portion and a downstream bent portion in the sheet feeding direction. Herein, the nip forming member 24 is configured to satisfy relationships $h1 \leq h3$ and $h2 \leq h3$, wherein h1 represents the height of the upstream end portion 24*a* from the nip portion N or a virtual extension E thereof, h2 represents the height of the downstream end portion 24*b* from the nip portion N or the virtual extension E, and h3 represents the maximum height of the remaining portion of the nip forming member 24 other than the upstream end portion 24*a* and the downstream end portion 24*b* from the nip portion N or the virtual extension E. With this configuration, the upstream end portion 24*a* of the nip forming member 24 is not located between the fixing belt 21 and the upstream bent portion of the stay 25. More strictly, a lower portion of the upstream end portion 24*a* is not located between the fixing belt 21 and the outer portion of the upstream bent portion of the stay 25. Further, the downstream end portion 24*b* of the nip forming member 24 is not located between the fixing belt 21 and the downstream bent portion of the stay 25. Therefore, the stay 25 is disposed with the upstream and downstream bent portions thereof located relatively close to the inner circumferential surface of the fixing belt 21. Accordingly, the size of the stay 25 is increased as much as possible in the limited space inside the fixing belt 21, and the strength of the stay 25 is secured. Consequently, the nip forming member 24 is prevented from being bent by the pressure roller 22, and the fixing performance is improved.

Figure 8A:
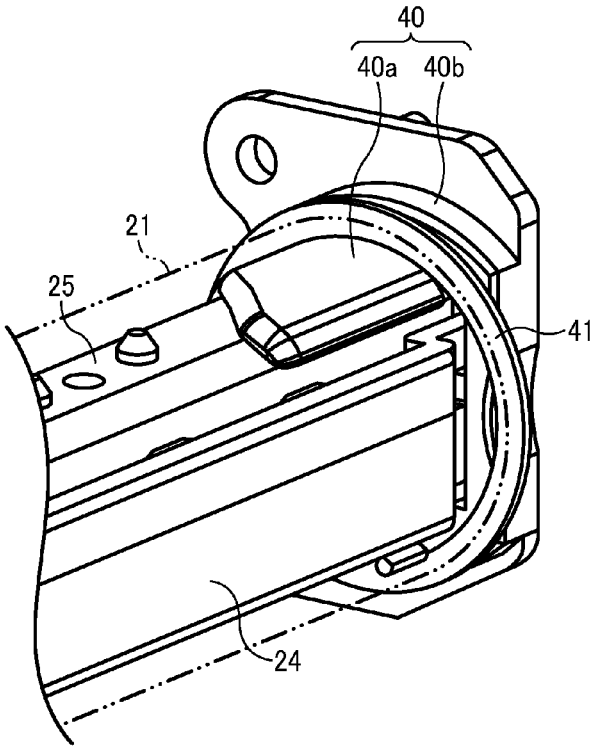
FIGS. 8A to 8C are diagrams illustrating the configuration of one end portion of a fixing belt included in the fixing device, FIG. 8A being a perspective view, FIG. 8B being a plan view, and FIG. 8C being a side view as viewed in the direction of the rotation axis of the fixing belt.
Figure 8B:
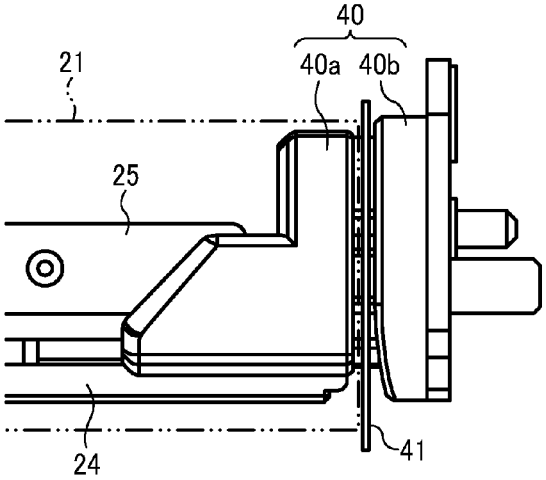
Figure 8C:
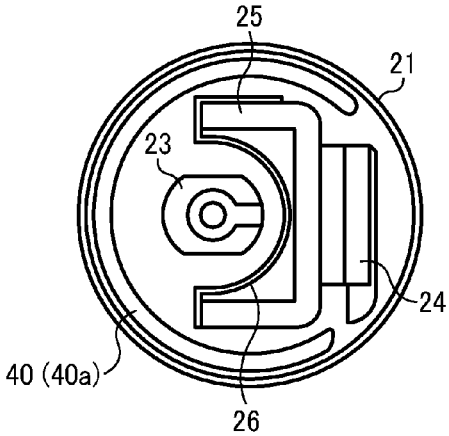

FIGS. 8A to 8C are diagrams illustrating the configuration of one end portion of the fixing belt 21. FIG. 8A is a perspective view, FIG. 8B is a plan view, and FIG. 8C is a side view as viewed in the direction of the rotation axis of the fixing belt 21. The illustration of FIGS. 8A to 8C is limited to the configuration of one end portion of the fixing belt 21. Although not illustrated, the other end portion of the fixing belt 21 has a similar configuration. In the following, therefore, description with reference to FIGS. 8A to 8C will be limited to the configuration of the one end portion of the fixing belt 21.

As illustrated in FIGS. 8A and 8B, a belt holding member 40 is inserted in and rotatably holds an end portion of the fixing belt 21. In the present embodiment, an end portion of the stay 25 is fixed to and positioned by the belt holding member 40.

The belt holding member 40 includes an insertion portion 40*a* and a restricting portion 40*b*. The insertion portion 40*a* is inserted in the end portion of the fixing belt 21. The restricting portion 40*b* is formed to be larger in outer diameter than the insertion portion 40*a*, and to be larger than at least the outer diameter of the fixing belt 21. If the fixing belt 21 walks in the axial direction thereof, the restricting portion 40*b* restricts the belt walk. As illustrated in FIG. 8C, the insertion portion 40*a* is formed into a substantially C-shape having an opening at a position corresponding to the nip portion N, i.e., a position provided with the nip forming member 24.

As illustrated in FIGS. 8A and 8B, a ring-shaped slip ring 41 serving as a protecting member for protecting the end portion of the fixing belt 21 is provided between an end surface of the fixing belt 21 and the restricting portion 40*b* of the belt holding member 40 facing the end surface of the fixing belt 21. It is desired to use so-called super engineering plastic having relatively high heat resistance, such as PEEK, PPS, and PAI, for example, as the material forming the slip ring 41.

Although not illustrated, blocking members for blocking the heat from the halogen heater 23 are provided to the end portions in the axial direction of the fixing belt 21 between the fixing belt 21 and the halogen heater 23. This configuration suppresses an excessive increase in temperature in sheet non-passing areas of the fixing belt 21 particularly in continuous sheet feeding, and thereby prevents degradation or damage of the fixing belt 21 due to heat.

With reference to FIG. 7, a basic operation of the fixing device 20 according to the present embodiment will now be described. When a not-illustrated power switch provided to the body of the image forming apparatus 1 is turned on, power is supplied to the halogen heater 23. At the same time, the pressure roller 22 starts to be driven to rotate in the clockwise direction in FIG. 7. Thereby, the fixing belt 21 is driven to rotate in the counterclockwise direction in FIG. 7 by frictional force acting between the pressure roller 22 and the fixing belt 21.

Thereafter, the sheet P carrying an unfixed toner image T formed by the foregoing image forming process is fed in the direction of an arrow A1 in FIG. 7 while being guided by not-illustrated guide plates, and is fed into the nip portion N between the fixing belt 21 and the pressure roller 22 in pressure-contact with each other. Then, the toner image T is fixed on a surface of the sheet P by the heat of the fixing belt 21 heated by the halogen heater 23 and the pressure force acting between the fixing belt 21 and the pressure roller 22.

The sheet P having the toner image T fixed thereon is fed out of the nip portion N in the direction of an arrow A2 in FIG. 7. In this process, the leading end of the sheet P comes into contact with the leading end of the separator 28, and thereby the sheet P is separated from the fixing belt 21. Thereafter, the separated sheet P is discharged outside the image forming apparatus 1 by the sheet discharge roller pair 13 and placed onto the sheet discharge tray 14, as described above.

Figure 9:
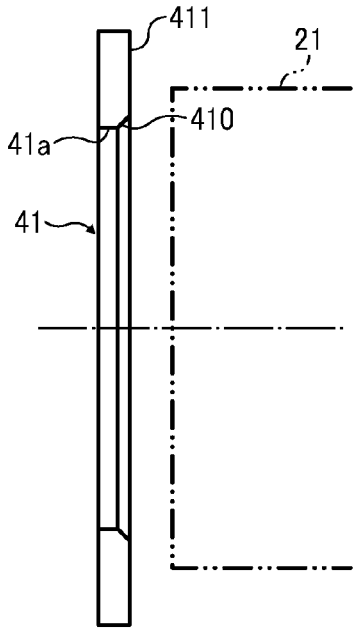
FIG. 9 is an enlarged cross-sectional view of a slip ring included in the fixing device.
Figure 10:
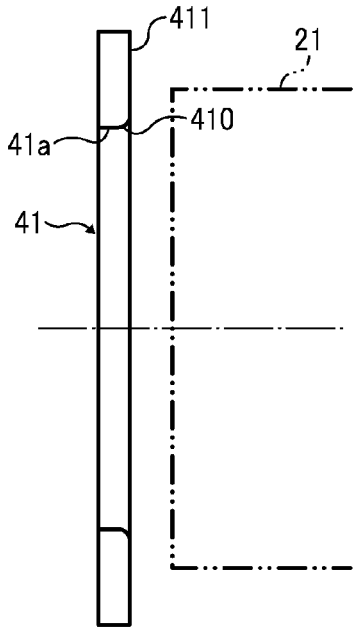
FIG. 10 is an enlarged cross-sectional view of a modified example of the slip ring, which includes a curved inclined surface.

The configuration of the slip ring 41 will now be described in detail. FIG. 9 is an enlarged cross-sectional view of the slip ring 41. As illustrated in FIG. 9, the slip ring 41 includes an opposite surface 411 facing the fixing belt 21. The opposite surface 411 is basically disposed to be perpendicular to the axial direction of the slip ring 41, i.e., the axial direction of the fixing belt 21. An inner diameter-side end edge of the opposite surface 411 is provided with an inclined surface 410 inclined relative to the axial direction. Specifically, the inclined surface 410 is inclined in the inner diameter direction and away from the fixing belt 21, i.e., toward the left side of FIG. 9. In the present embodiment, the slip ring 41 has a thickness of approximately 0.5 mm in the axial direction thereof, and the inner diameter-side end edge of the slip ring 41 is chamfered by approximately 0.3 mm to form the inclined surface 410. Although the inclined surface 410 is formed into a substantially flat surface in the present embodiment, the inclined surface 410 may be formed into a curved surface, as illustrated in FIG. 10.

Figure 11:
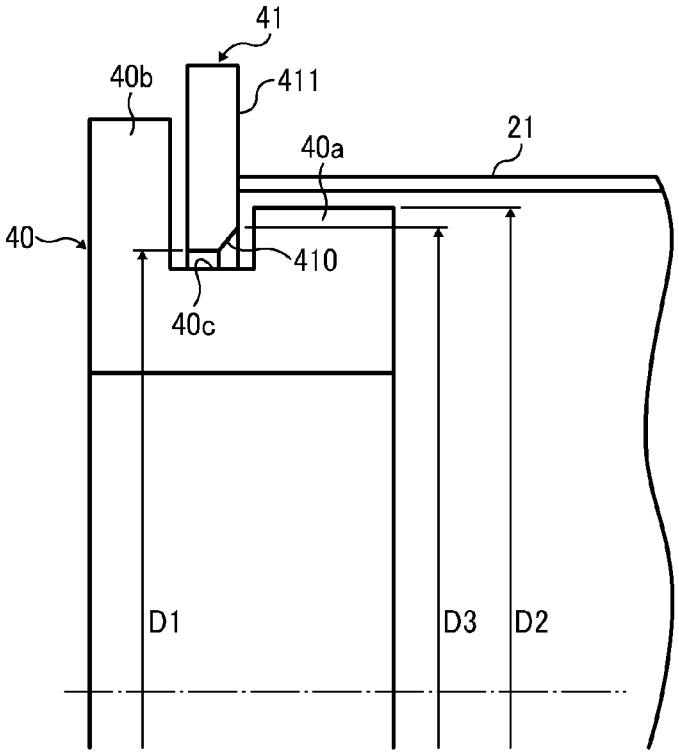
FIG. 11 is a cross-sectional view illustrating a state in which the slip ring is attached to a belt holding member of the fixing device.

FIG. 11 is a cross-sectional view illustrating a state in which the slip ring 41 is attached to the belt holding member 40. As illustrated in FIG. 11, the slip ring 41 is attached in a groove portion 40*c* formed between the insertion portion 40*a* and the restricting portion 40*b* of the belt holding member 40. The slip ring 41 is inserted from the side of the insertion portion 40*a* and attached into the groove portion 40*c*. In FIG. 11, D1 represents the inner diameter of the slip ring 41, D2 represents the outer diameter of the insertion portion 41*a*, and D3 represents the outer diameter of the inclined surface 410. In the present embodiment, the inner diameter D1 of the slip ring 41 is set to be smaller than the outer diameter D2 of the insertion portion 40*a*. When the slip ring 41 is inserted around the insertion portion 40*a*, the slip ring 41 is elastically deformed to some extent, and is attached into the groove portion 40*c*. Further, in the present embodiment, the outer diameter D2 of the insertion portion 40*a* is set to be larger than the outer diameter D3 of the inclined surface 410.

The operation and effects of the slip ring 41 will now be described. During the rotation of the fixing belt 21, if the fixing belt 21 is subjected to a force exerted in the axial direction thereof and walks toward one side, an end portion of the fixing belt 21 hits against the corresponding slip ring 41. The slip ring 41 fits around the belt holding member 40 with a gap provided between the slip ring 41 and the outer circumference of the belt holding member 40. When the end portion of the fixing belt 21 comes into contact with the slip ring 41, therefore, the slip ring 41 rotates together with the fixing belt 21. Thereby, abrasion or damage of the end portion of the fixing belt 21 due to sliding friction of the end portion of the fixing belt 21 with the belt holding member 40 is prevented.

The slip ring 41 may also be configured to remain at rest, without rotating together with the fixing belt 21. In this case, if the slip ring 41 is made of a material having a relatively low coefficient of friction, or if a process of reducing the coefficient of friction is performed on the slip ring 41, the abrasion or damage of the end portion of the fixing belt 21 is prevented.

Figure 12:
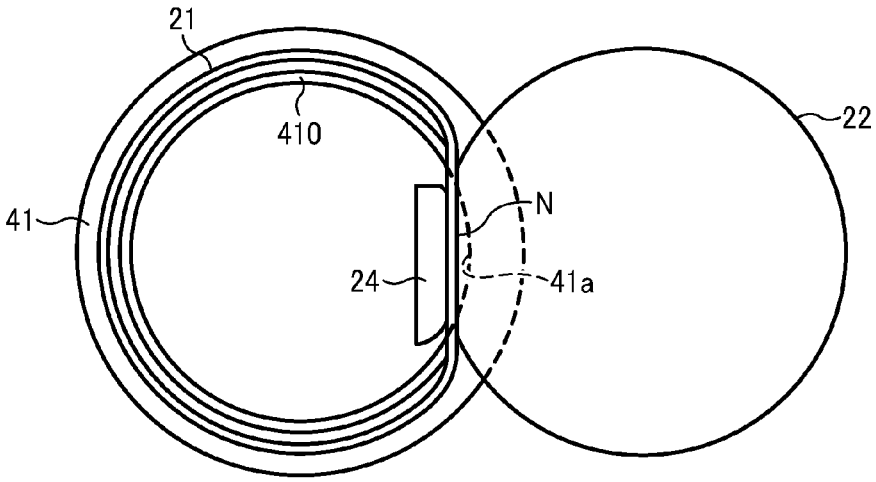
FIG. 12 is a diagram illustrating a state in which the fixing belt is pressed and recessed inward from an inner circumferential surface of the slip ring in a nip portion.
Figure 13:
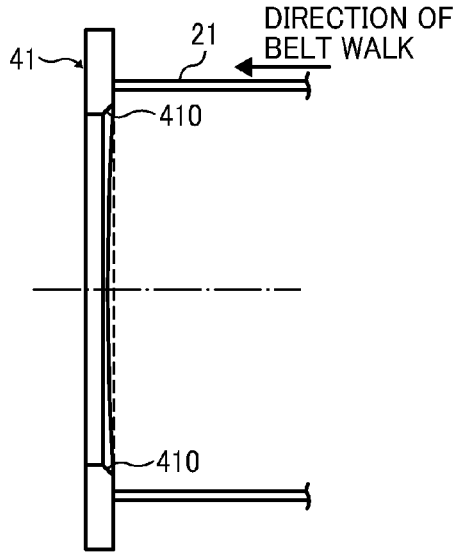
FIG. 13 is a diagram illustrating a state in which the end portion of the fixing belt is in contact with an inner diameter-side end edge of the slip ring.

Further, as illustrated in FIG. 12, the nip forming member 24 is provided inside an inner circumferential surface 41*a* of the slip ring 41. In the nip portion N, therefore, the fixing belt 21 is pressed toward the inner diameter thereof by the pressure roller 22, and thereby is recessed inward from the inner circumferential surface 41*a* or the inner diameter-side end edge of the slip ring 41. In the area in which the fixing belt 21 is thus pressed toward the inner diameter thereof, the end surface of the fixing belt 21 is not in contact with the slip ring 41, and thus is not supported by the slip ring 41. In the area in which the fixing belt 21 is pressed toward the inner diameter thereof, therefore, the end portion of the fixing belt 21 is in contact with the inner diameter-side end edge of the slip ring 41, as illustrated in FIG. 13.

In the present embodiment, however, the inner diameter-side end edge of the slip ring 41 is provided with the inclined surface 410. With this configuration, therefore, the concentration of stress on the end portion of the fixing belt 21 due to the contact between the end portion of the fixing belt 21 and the inner diameter-side end edge of the slip ring 41 is mitigated. Accordingly, the abrasion or damage of the end portion of the fixing belt 21 is prevented, and the function of the fixing belt 21 is favorably maintained for a relatively long period of time.

Particularly in a fixing device using a relatively thin fixing belt to reduce the heat capacity, as in the present embodiment, the strength of the fixing belt is reduced. Therefore, the above-described configuration according to an embodiment of the present invention is expected to be substantially effective, when applied to such a fixing device.

Further, a portion of the end surface of the fixing belt 21 other than a portion of the end surface corresponding to the nip portion N is in contact with the opposite surface 411 of the slip ring 41 perpendicular to the axial direction thereof. In the present embodiment, the outer diameter D2 of the insertion portion 40*a* is set to be larger than the outer diameter D3 of the inclined surface 410, as illustrated in FIG. 11. Therefore, the portion of the end surface of the fixing belt 21 other than the portion of the end surface corresponding to the nip portion N is reliably brought into contact with the opposite surface 411 of the slip ring 41. Accordingly, the end portion of the fixing belt 21 is held in a stable posture, and is prevented from hitting against a corner of the inner diameter-side end edge of the slip ring 41.

Further, in the present embodiment, the inner diameter D1 of the slip ring 41 is set to be smaller than the outer diameter D2 of the insertion portion 40*a*, as illustrated in FIG. 11. Therefore, the end portion of the fixing belt 21 is prevented from slipping into the gap between the inner circumferential surface of the slip ring 41 and the outer circumferential surface of the belt holding member 40.

Further, to more reliably prevent the abrasion or damage of the end portion of the fixing belt 21, it is particularly desired to set the coefficient of friction of the inclined surface 410 to be lower than the coefficient of friction of the remaining portion of the slip ring 41. For example, coating the inclined surface 410 with a material having a relatively low coefficient of friction, such as a fluororesin, is a simple method of reducing the coefficient of friction. The abrasion tends to occur particularly in the inclined surface 410. Therefore, it is desired to select a fluororesin having relatively high abrasion resistance. With this configuration, shearing force acting on the fixing belt 21 on the inclined surface 410 is reduced, and the abrasion or damage of the end portion of the fixing belt 21 is more reliably prevented.

As another method of reducing the coefficient of friction, a lubricant, such as silicone oil, may be applied to the inclined surface 410. Also in this case, the shearing force acting on the fixing belt 21 on the inclined surface 410 is reduced, and the abrasion or damage of the end portion of the fixing belt 21 is more reliably prevented. In this case, abrasion of the slip ring 41 is also prevented. A similar effect is obtained by the application of a lubricant to the end portion or the end surface of the fixing belt 21.

The above-described process of reducing the friction of the inclined surface 410 is particularly effective in the configuration in which the slip ring 41 does not rotate. The abrasion of the end portion of the fixing belt 21 may occur even in the configuration in which the slip ring 41 rotates together with the fixing belt 21, if the rotation of the slip ring 41 and the rotation of the fixing belt 21 are slightly out of synchronization. In this case, therefore, it is desired to perform the process of reducing the friction of the inclined surface 410, similarly as in the above-described embodiment.

Figure 14:
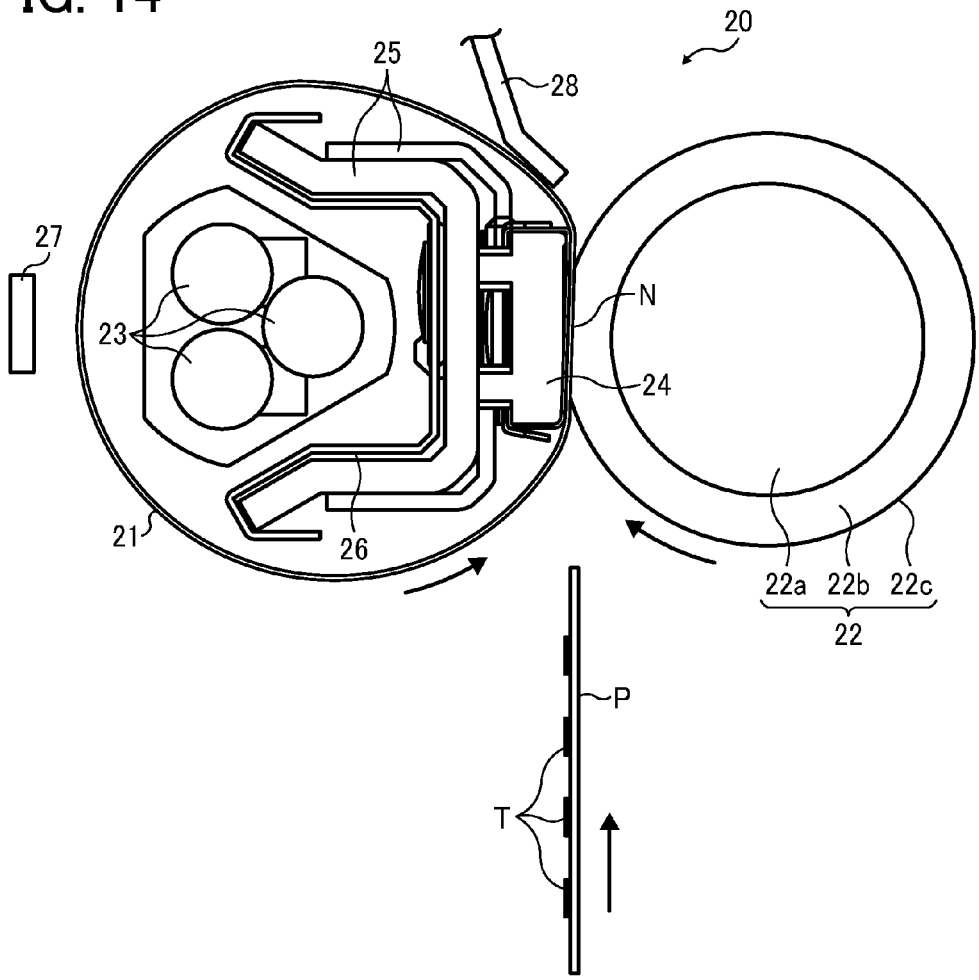
FIG. 14 is a schematic configuration diagram of a fixing device according to a second embodiment of the present invention.

The application of the present invention is not limited to the fixing device according to the above-described embodiment. For example, the present invention is also applicable to a fixing device including a plurality of halogen heaters 23, as illustrated in FIG. 14. In this case, if the halogen heaters 23 are configured to have different heat generating areas, it is possible to heat the fixing belt 21 in the area depending on the difference in sheet width.

Further, the application of a fixing device according to an embodiment of the present invention is not limited to the color laser printer illustrated in FIG. 6. The fixing device is also installable in, for example, a monochrome image forming apparatus, a different type of printer, a copier, a facsimile machine, and a multifunction machine combining several of the functions of these apparatuses.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A fixing device which fixes an unfixed image on a recording medium, the fixing device comprising:

a rotatable endless fixing rotary member configured to come into contact with the unfixed image carried on the recording medium;

a heating source configured to heat the fixing rotary member;

an opposite rotary member configured to be in contact with an outer circumferential surface of the fixing rotary member;

a nip forming member provided inside the fixing rotary member and being a heat resistant member, and configured to be in contact with the opposite rotary member via the fixing rotary member to form, between the fixing rotary member and the opposite rotary member, a nip portion to which the recording medium carrying the unfixed image is fed;

holding members configured to rotatably hold end portions of the fixing rotary member; and protecting members provided between the holding members and end surfaces of the fixing rotary member, and configured to protect the end portions of the fixing rotary member, the protecting members each having an opposite surface which faces the corresponding one of the end surfaces of the fixing rotary member and includes an inner diameter-side end edge provided with an inclined surface inclined in an inner diameter direction and away from the fixing rotary member, and the opposite surface of each of the protecting members is perpendicular to an axial direction of the fixing rotary member and is in contact with the corresponding one of the end surfaces of the fixing rotary member.

2. The fixing device according to claim 1, wherein the inclined surface comprises a substantially flat surface.

3. The fixing device according to claim 1, wherein the inclined surface comprises a curved surface.

4. The fixing device according to claim 1, wherein, in the nip portion, the fixing rotary member is pressed toward the inner diameter thereof by the opposite rotary member and recessed inward from the inner diameter-side end edge of each of the protecting members.

5. The fixing device according to claim 1, wherein each of the holding members includes an insertion portion inserted in the corresponding one of the end portions of the fixing rotary member and larger in outer diameter than the inclined surface.

6. The fixing device according to claim 1, wherein the inclined surface of each of the protecting members has a lower coefficient of friction than the remaining portion of the protecting member.

7. The fixing device according to claim 6, wherein the inclined surface is coated with a material having a coefficient of friction lower than that of the inclined surface.

8. The fixing device according to claim 6, further comprising a lubricant applied to the inclined surface.

9. An image forming apparatus comprising:

an image forming unit configured to form an unfixed image on a recording medium; and a fixing device according to claim 1, configured to fix the unfixed image on the recording medium.

10. The fixing device according to claim 1, wherein each of the holding members includes a groove portion.

11. The fixing device according to claim 10, wherein each of the protecting members is attached into the groove portion of each of the holding members.

12. The fixing device according to claim 1, wherein each of the holding members includes an insertion portion inserted in the end portion of the fixing rotary member.

13. The fixing device according to claim 12, wherein each of the protecting members includes an inclined surface inclined relative to an axial direction of the protecting members.

14. The fixing device according to claim 12, wherein an inner diameter of the protecting member is smaller than an outer diameter of the insertion portion of the holding members.

15. The fixing device according to claim 14, wherein the outer diameter of the insertion portion of the holding member is greater than an outer diameter of the inclined surface of the protecting members.

* * * * *